United States Patent [19]

Kimura et al.

[11] Patent Number: 4,875,080

[45] Date of Patent: Oct. 17, 1989

[54] METHOD OF AND APPARATUS FOR DEVELOPING ELECTROPHOTOGRAPHIC FILM USING LIQUID DEVELOPER

[75] Inventors: Akinori Kimura; Akira Yoda, both of Kanagawa, Japan

[73] Assignee: Fuji Photo Film Co., Ltd., Kanagawa, Japan

[21] Appl. No.: 217,103

[22] Filed: Jul. 5, 1988

Related U.S. Application Data

[63] Continuation of Ser. No. 3,359, Jan. 14, 1987, abandoned.

[30] Foreign Application Priority Data

Jan. 14, 1986 [JP] Japan ..... 61-5723

[51] Int. Cl.[4] ..... G03G 15/10

[52] U.S. Cl. ..... 355/246; 355/256; 118/647; 118/659; 430/103; 430/117

[58] Field of Search ..... 355/10, 14 D, 3 R, 214, 355/246, 256; 118/647, 659; 430/103, 117, 119

[56] References Cited

U.S. PATENT DOCUMENTS

| | | | |
|---|---|---|---|
| 4,319,544 | 3/1982 | Weber | 355/10 X |
| 4,563,080 | 1/1986 | Ottley | 355/10 |
| 4,624,554 | 11/1986 | Ohtsuka et al. | 355/3 R X |

*Primary Examiner*—Arthur T. Grimley
*Assistant Examiner*—J. Pendegrass
*Attorney, Agent, or Firm*—Sughrue, Mion, Zinn, Macpeak & Seas

[57] ABSTRACT

A developing apparatus wherein a developer is supplied to an exposed electrophotographic film to develop an image formed on the film has a developing section provided with an electrode which is disposed in opposing relation to the film. A bias voltage of the same polarity as that of the film which is electrically charged is applied to the electrode to prevent fogging of the image. The bias voltage is lowered or made opposite in polarity for a relatively short period of time, thereby momentarily improving the adhesion of the developer to the film, and thus allowing the developer to reliably adhere even to a relatively low density portion of the image.

20 Claims, 23 Drawing Sheets

METHOD OF AND APPARATUS FOR DEVELOPING ELECTROPHOTOGRAPHIC FILM USING LIQUID DEVELOPER

BACKGROUND OF THE INVENTION

1. Field of the Invention

The present invention relates to a method of developing an electrophotographic film using a liquid developer, and an apparatus which may suitable be employed to carry out said method.

2. Description of the Related Art

One type of photographic apparatus has heretofore been known which is capable of recording an image on a predetermined frame of a photographic film and of projecting or copying the recorded image. This type of apparatus is disclosed in, for example, U.S. Pat. Nos. 3,528,355, 3,697,173, 3,964,828, 3,972,610 and 4,461,561.

A processing head is disposed in such photographic apparatus to subject an electrophotographic film to various kinds of processing such as charging/exposure and development and such processing head is known from the specifications of U.S. Pat. No. 4,600,291 and U.S. patent application Ser. No. 696,590 filed Jan. 31, 1985.

One type of electrophotographic film is formed by successively coating an electrically conductive layer and a photosensitive layer on a carrier. Such electrophotographic film is electrically charged and then exposed to form an electrostatic latent image on the photosensitive layer, and the film is then developed to make the latent image visible. For development of this type of electrophotographic film, it is general practice to employ a liquid developer which is formed by dispersing into a solvent tonner particles which are charged opposite in polarity to the electrophotographic film that is electrically charged. In development of the film, the above-described liquid developer is supplied onto the electrostatic latent image to make it visible.

The processing head of the type described above is provided with a developing section having an electrode which is generally disposed so as to face the photosensitive layer side of an electrophotographic film. A portion of the film which has an electrostatic latent image formed thereon is positioned at the developing section, and the above-described liquid developer is supplied to a gap defined between the photosensitive layer side of the film and the developing electrode, thereby developing the film. The presence of the developing electrode enables obtaining of an image having no edge effect. In addition, the application of a bias voltage to the developing electrode prevents fogging of the background of the image, the bias voltage having the same polarity as that of the charged photosensitive layer.

The photosensitive layer having an electrostatic latent image formed thereon has a relatively low potential at a portion thereof which will result in a solid half-tone portion of a finished image. For this reason, the toner electrostatically adheres to this portion at a relatively low speed, which gives rise to a problem in a developing system wherein a liquid developer is allowed to flow from the upper side to the lower side of an electrophotographic film positioned at the developing section. More specifically, in such developing system the speed of flow of the liquid developer is higher than the speed at which toner particles are moved toward the solid half-tone portion by the effect of electrostatic field, so that a less amount of toner adheres to a region of the solid half-tone portion which is positioned on the upstream side as viewed in the direction of flow of the developer, resulting disadvantageously in an image having a nonuniform density at the solid half-tone portion.

A low-contrast thin-line portion of the electrostatic latent image also has a relatively low potential, that is, a relatively weak electrostatic force for attracting toner particles. Therefore, the speed at which toner particles adhere to such thin-line portion is low as compared with the speed of flow of the liquid developer, and this leads to occurrence of the phenomenon that no toner particles adhere to the thin-line portion of the latent image. Such tendency is particularly noticeable in a thin-line pattern which extends perpendicularly to the direction of flow of the liquid developer. Thus, the conventional developing method using a liquid developer involves the problem that a finished image has an undesirably low density at a portion including a thin-line pattern such as a character.

SUMMARY OF THE INVENTION

In view of the above-described circumstances, it is a primary object of the present invention to provide a method of developing an electrophotographic film using a liquid developer, which enables the image density at a solid half-tone portion to be made uniform and also permits a low-contract thin-line pattern to be excellently reproduced, and also provide an apparatus which may suitably be employed to carry out said method.

To this end, the present invention provides a method of developing an electrophotographic film wherein a liquid developer is supplied to a gap defined between a photosensitive layer side of the film that is electrically charged and an electrode disposed in opposing relation to the photosensitive layer side, and a bias voltage of the same polarity as that of the charged film is applied to the electrode to develop the film, the method comprising: switching over the bias voltage to either a voltage opposite in polarity to the charged film or a voltage which has the same polarity as that of the charged film and which is lower than the bias voltage at least once for a relatively short period of time.

The present invention also provides an apparatus which may effectively be employed to carry out the above-described developing method.

The present invention will briefly be summarized below with reference to FIGS. 23 and 24.

FIG. 23 schematically shows the way in which a solid half-tone latent image is developed. In this figure, the reference symbol Y denotes the direction of flow of a developer, and the symbol Z denotes a direction which is perpendicular to the respective planes of an electrophotographic film 24 and a developing electrode 96. In a developing method using a liquid developer, toner particles T in the developer are allowed to flow in the direction Y, and while doing so, they are attracted so as to adhere to an electrostatic latent image formed on the film 24 by the effect of a Z-direction component of an electric field produced by the electrostatic latent image and the developing electrode 96.

The electric field has an effect on the density distribution of toner particles More specifically, the toner particle distribution is localized by the electric field in such a manner that, at a background portion (a portion a) of the latent image, more toner particles gather toward the developing electrode 96, whereas, at a solid half-tone portion (a portion a to b) of the latent image which has a higher potential than that of the background portion, more toner particles than those at the background portion gather toward the electrophotographic film 24. It should be noted that the actual deviation of toner density distribution does not occur through the whole area of the gap (about 300 μm to 400 μm) between the film 24 and the developing electrode 96 as illustrated but occurs within a range of about 10 μm from the surface of the film 24 in the direction Z. The illustration is made for convenience of explanation.

FIGS. 24(A) to 24(C) show the relationship between the field intensity $E_Z$ in the direction Z (shown on the left-hand side as viewed in these figures) and the toner density distribution in the direction Z (shown on the right-hand side as viewed in the figures) for each of the background portion a of the latent image, the upstream region b, intermediate region c and downstream region d of the solid half-tone portion.

Referring to FIG. 24(A), in the early stage of development, the field intensity $E_Z$ shows a distribution corresponding to the solid half-tone latent image. However, since the toner density distribution is biased toward the developing electrode 96 at the background portion a as described above, the toner density distribution at the upstrem region b of the solid half-tone latent image is biased toward the developing electrode 96 by being strongly affected by said tendency.

Since the solid half-tone latent image has a relatively low potential, the field intensity $E_Z$ is also relatively weak. Therefore, toner particles which are present in a region that is relatively close to the film 24 alone are attracted to the film 24 within a period of time when the developer passes through the electric field relative to the latent image. Said region, that is, a range within which the effect of electric field extends, is shown by the broken line in the toner density distribution charts.

Accordingly, as will be clear from FIG. 24(A), the upstream region a of the solid half-tone latent image has a relatively small amount of toner particles which contribute to development, so that the density at said region would be lower than that at other regions of the solid half-tone latent image portion, resulting in a nonuniform density of the solid half-tone image.

FIG. 24(B) shows a state wherein the development has progressed from the state shown in FIG. 24(A). As the development progresses, the field intensity $E_Z$ becomes relatively weak at a portion of the film 24 to which a relatively large amount of toner particles has adhered, and said effective range of electric field also changes.

FIG. 24(C) shows a state wherein the bias voltage is lowered when the development is in the state shown in FIG. 24(B). When the bias voltage is lowered, the field intensity $E_Z$ increases uniformly at the portions a to d, and the effective range of electric field is increased. In consequence, the amount of toner particles which contribute to development increases by a large margin particularly at the upstream region a of the solid half-tone latent image portion, and the upstrem region a, which has had a small amount of toner particles adhered thereto as compared with the other regions of the solid half-tone latent image portion, is thereby allowed to have an amount of adhesion of toner which is substantially equal to that of the other regions.

It should be noted that the background portion a of the latent image has only a slight increase in the amount of toner particles which contribute to development since the field intensity $E_Z$ at this portion is weak from the first and the toner density distribution is biased toward the developing electrode 96. There is therefore no fear of fogging occurring at the background portion a.

However, if the bias voltage were left at the lowered level, the toner density distribution would gradually change in a direction in which the toner density on the film 24 side becomes higher, resulting in occurrence of fogging at the background portion a. According to the present invention, however, the period of time during which the bias voltage is maintained at a lowered level is sufficiently short as compared with the period of time beyond which the toner density distribution begins to change. Therefore, the occurrence of fogging is not encouraged.

Thus, since it is possible to prevent reduction in the amount of adhesion of toner particles at the upstream region a of the solid half-tone latent image portion, the density at the solid half-tone portion of the developed image becomes uniform, advantageously.

The period of time during which the bias voltage is maintained at a lowered level is preferably set at 10 msec or more for the purpose of obtaining a satisfactorily uniform image density and, at the same time, said period is preferably set at 200 msec or less with a view to suppressing the occurrence of fogging.

Although the description has been made about the density of a solid half-tone image, the present invention may also be applied to a low-contrast thin-line latent image. In such case also, the present invention acts so as to increase the density of the thin-line pattern to a substantial extent in a manner similar to that described above.

It should be noted that, if the lowering of the bias voltage is carried out during a pressure squeezing operation which is conducted to discharge the developer after completion of a developing operation, it is possible to obtain the above-described advantageous effects at substantially no sacrifice of the fogging preventing effect.

More specifically, the prevention of fogging is effected by producing an electric field which causes toner particles to be attracted to the developing electrode. Therefore, the fogging preventing effect can be improved by raising the biasing voltage and thereby intensifying said electric field. In such case, however, it is easier for toner particles to adhere to the developing electrode than in a normal biased state. Since the electric charge accumulated on toner particles which have adhered to the developing electrode does not attenuate immediately but remains on the developing electrode for a relatively long period of time, i.e., 100 to 300 sec. The presence of this electric charge undesirably weakens the electric field produced by the developing electrode and therefore gradually impairs the fogging preventing effect.

On the other hand, when a bias voltage which is opposite in polarity to the charged electrophotographic film, that is, a bias voltage of the same polarity as that of the charged toner particles, is applied to the developing electrode, the toner particles are subjected to an electric field which acts on the toner particles in a direction in which they are moved away from the developing electrode. Accordingly, among the toner particles adhering to the developing electrode, those which have a relatively weak adhesive force are separated from the electrode. Otherwise, toner particles which are opposite in polarity to the toner particles in the developer adhere to the developing electrode and neutralize the electric charge on toner particles which have already adhered to the developing electrode, thus weakening the electric charge on this toner.

Accordingly, if, in such state, pressure squeezing for discharging the developer is effected through the gap between the developing electrode and the electrophotographic film, toner particles are effectively removed since a part of the toner particles have already been separated from the developing electrode and the toner particles still adhering to the electrode are also in an easily separable state. There is therefore no fear of toner particles being accumulated on the developing electrode. Accordingly, there is no risk of toner particles accumulated on the developing electrode weakening the fogging preventing effect during the development of subsequent frames of the film.

DESCRIPTION OF THE PREFERRED EMBODIMENT

The present invention will be described herein under in detail with reference to the accompanying drawings.

Figure 1:
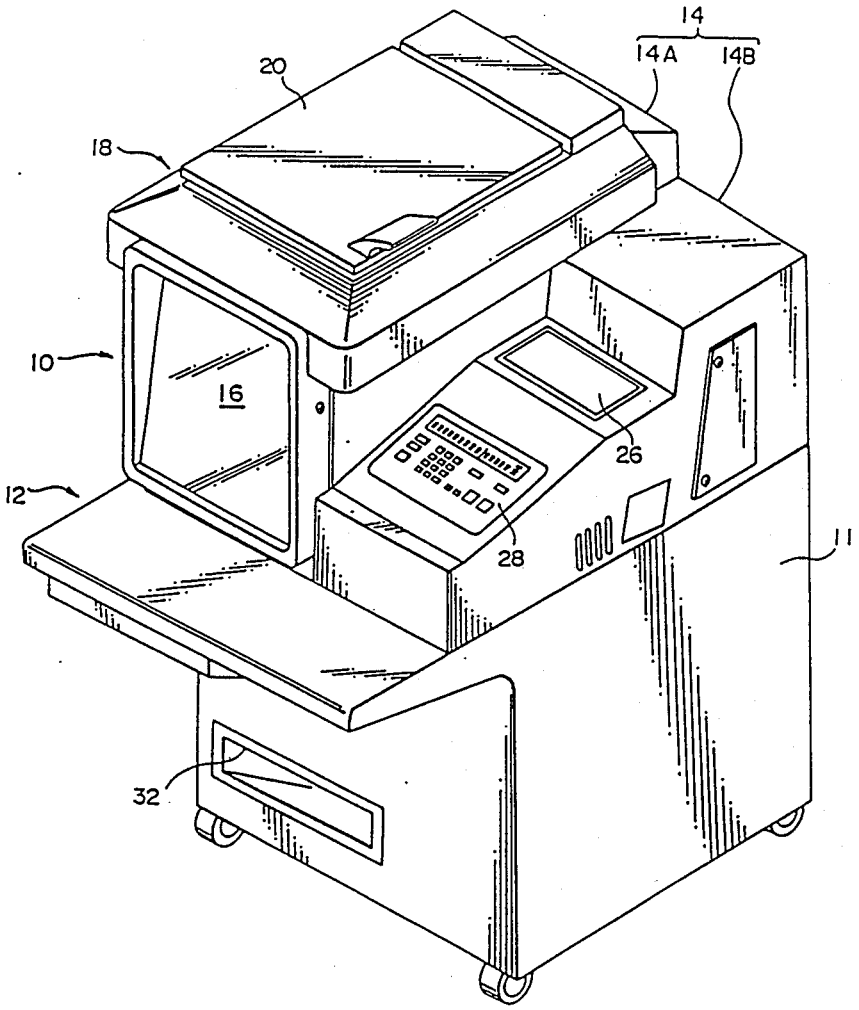
FIG. 1 is a perspective view showing the external appearance of one example of an electrophotographic apparatus.

FIG. 1 shows one example of an electrophotographic apparatus in which a processing head in accordance with one embodiment of the present invention is disposed. The electrophotographic apparatus has various functions: namely, the camera function which enables the image of a document to be recorded on an electrophotographic film; the reader function which enables the image recorded on the film to be enlarged and projected on a screen; and the copy function which enables the image recorded on the film to be enlarged and copied on a sheet of copying paper.

The electrophotographic apparatus has an integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular parallelepiped configuration and a right-hand portion 14B which has a stepped upper surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26 into which a cassette accommodating an electrophotographic microfilm 24 (see FIG. 2; hereinafter referred to as an "electrophotographic film") is loaded is provided in the central portion of the upper side of the housing portion 14B. A control keyboard 28 through which various controls of the electrophotographic apparatus are effected is disposed on the front portion of the upper side of the housing portion 14B.

Figure 4:
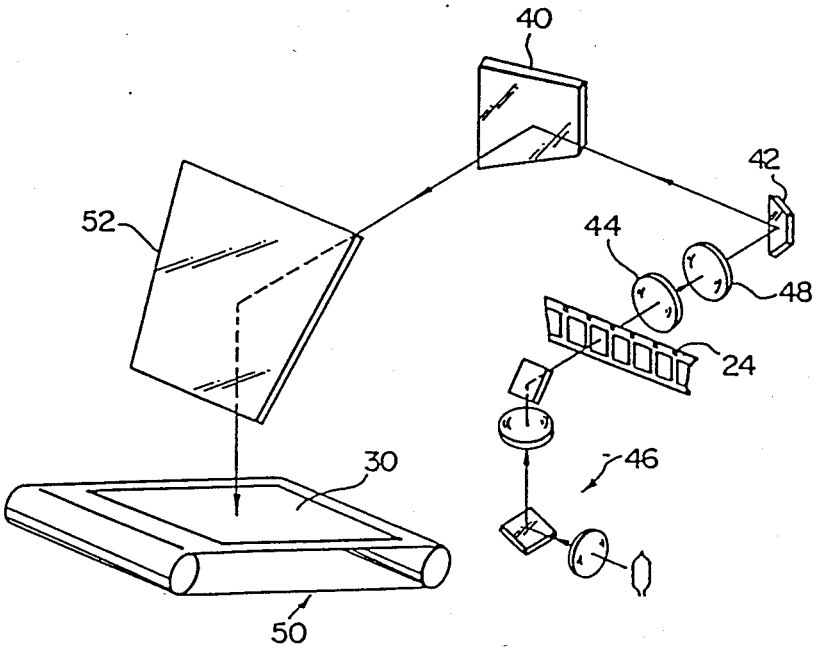
FIG. 4 is a perspective view of a copying optical system in the electrophotographic apparatus.

The housing 11 of the copying machine 12 is provided with an opening 32 for delivering a copied sheet of paper 30 (see FIG. 4).

Optical Systems of Electrophotographic Apparatus

Figure 2:
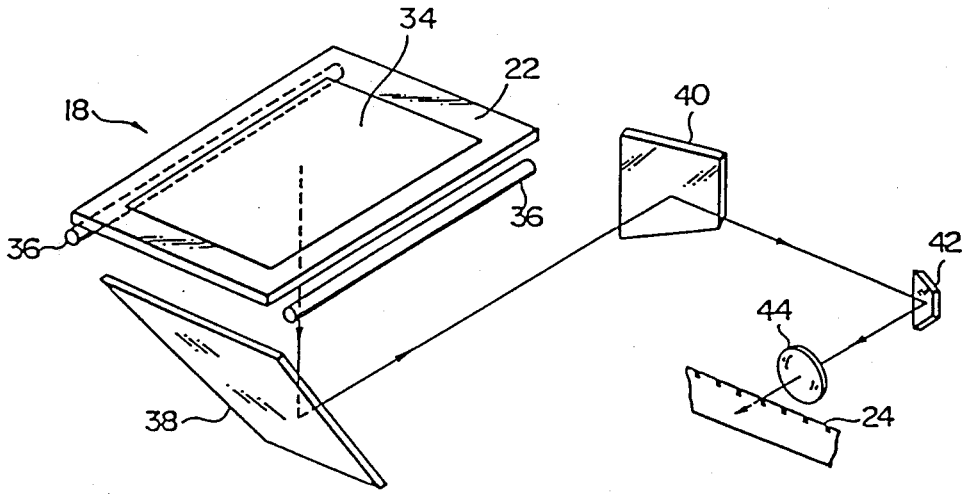
FIG. 2 is a schematic perspective view of a recording optical system in the electrophotographic apparatus.
Figure 3:
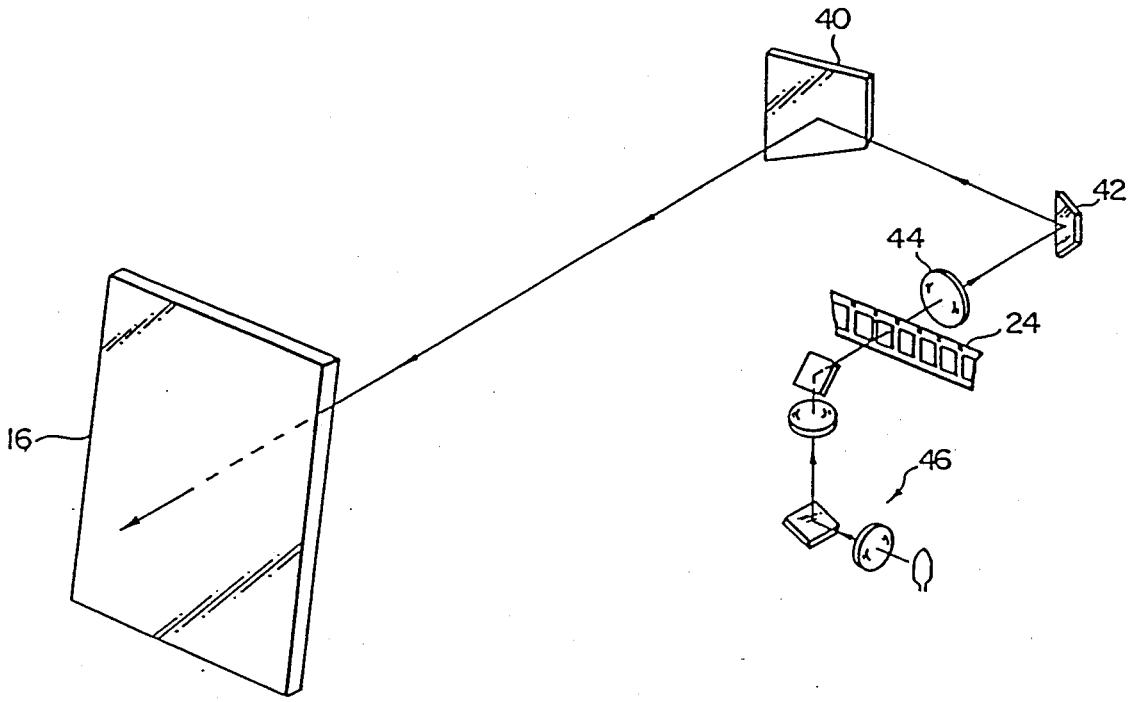
FIG. 3 is a schematic perspective view of a projecting optical system in the electrophotographic apparatus.

FIGS. 2 to 4 show various optical systems of the electrophotographic apparatus.

Referring first to FIG. 2, the recording optical system includes a document illuminating lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected from the second mirror 40 is made incident, and a main lens 44 for focusing the light reflected from the first mirror 42 on the surface of an electrophotographic film 24.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical systems. The main lens 44 and the first mirror 42 are fixedly disposed within the housing portion 14B of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interfering with any other optical systems. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

Processing Head

FIGS. 5 to 13 show in combination one embodiment of the processing head which is disposed in the above-described electrophotographic apparatus to carry out the method of developing an electrophotographic film using a liquid developer according to the present invention.

Figure 5:
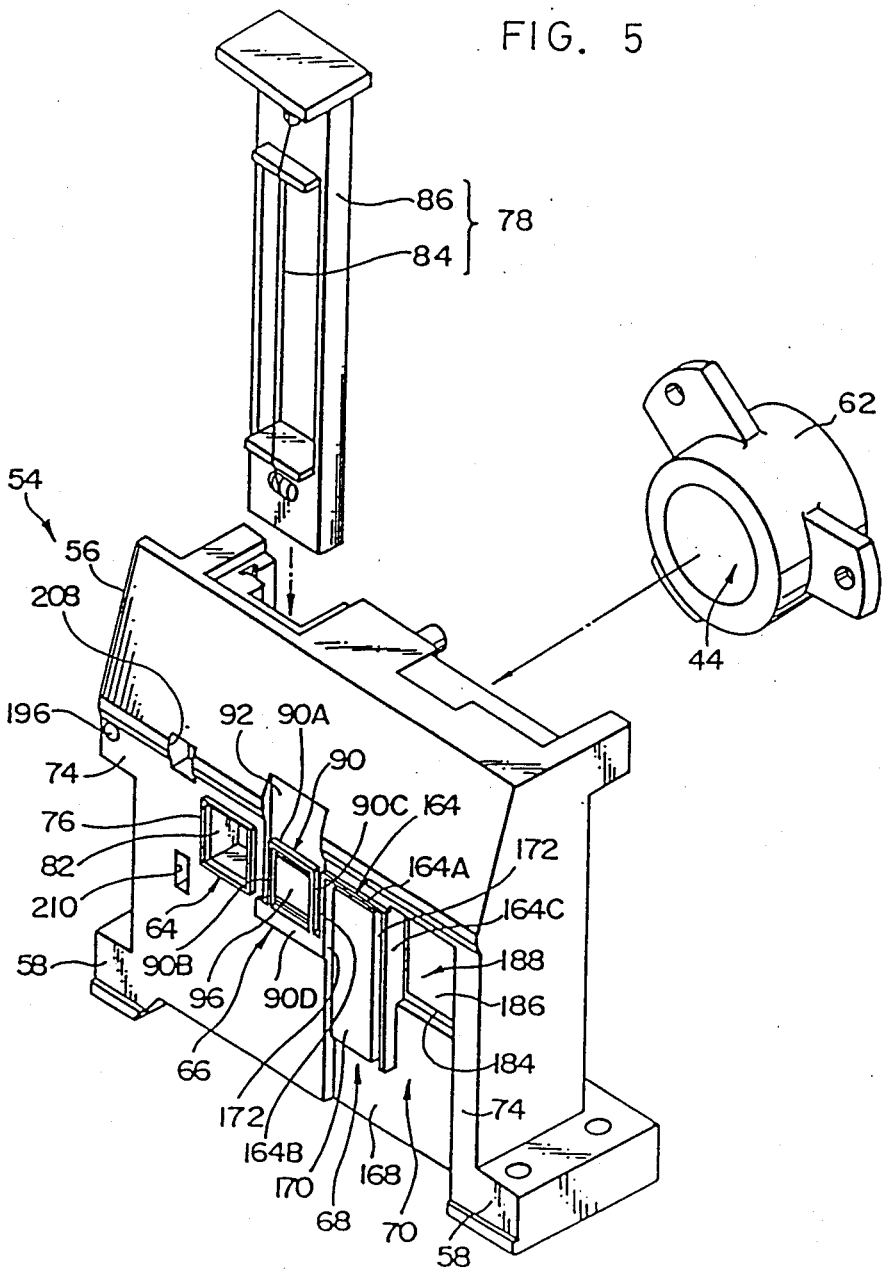
FIG. 5 is an exploded perspective view of a processing head in accordance with one embodiment of the present invention which is disposed in the electrophotographic apparatus shown in FIG. 1.
Figure 6:
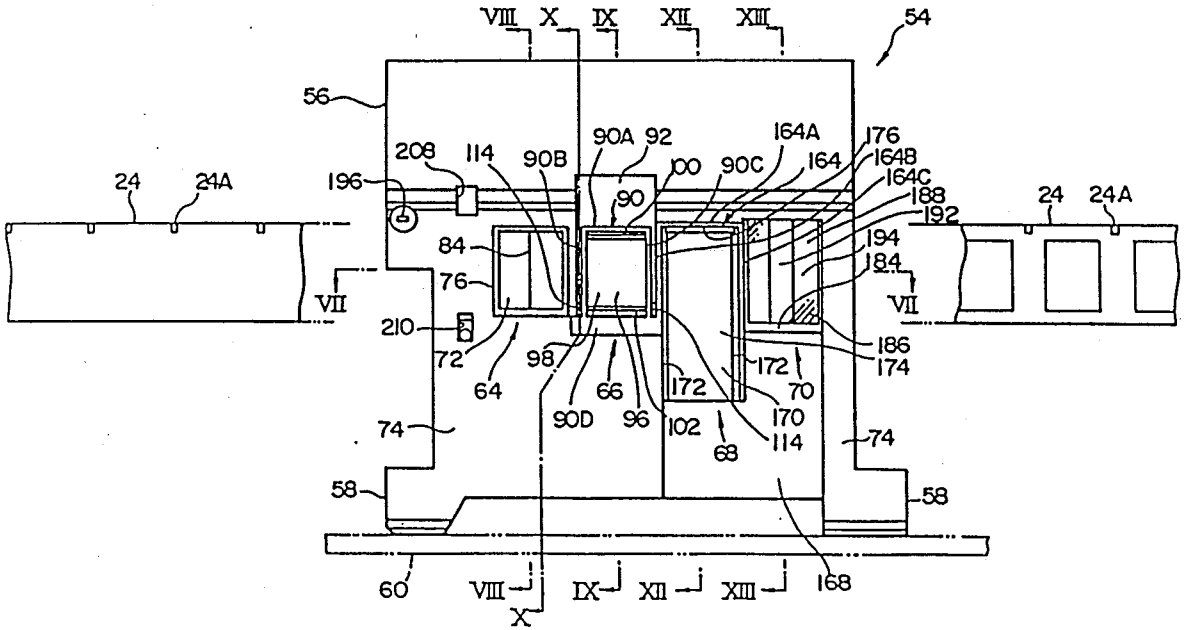
FIG. 6 is a front view of the processing head.

Referring first to FIGS. 5 and 6, the processing head 54 has an integral structure which consists of a relatively flat body portion 56 having a substantially rectangular parallelepiped configuration, and a pair of leg portions 58 located below the body portion 56. The processing head 54 is formed form a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
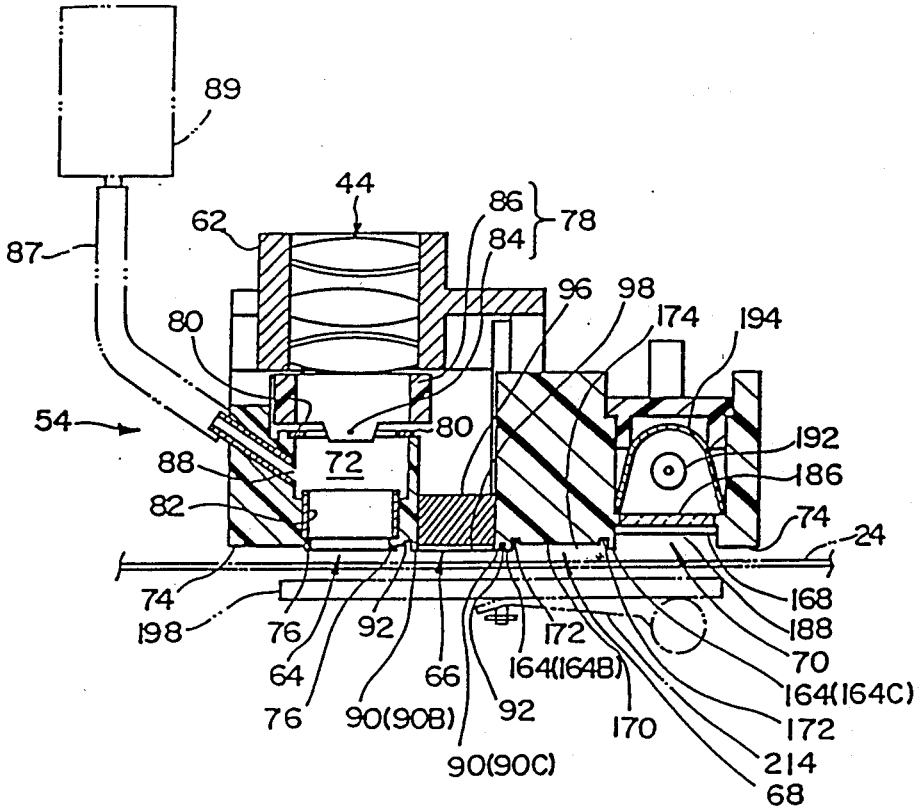
FIG. 7 is sectional view taken along the line VII—VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed in advance on the upper edge (as viewed in FIG. 6) of the film 24 at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown). The transparent electrically conductive layer of the film 24 is adapted to provide electrical connection with the apparatus body 10 when the cassette is loaded therein. It is a matter of course that any type of known electrophotographic film may be employed in addition to the film of the type described above.

As shown in FIGS. 5 to 7, a charging exposure section 64, a developing section 66, a drying section 68 and a fixing section 70 are successively formed in the body portion 56 of the processing head 54 along the lateral direction thereof at a constant pitch which corresponds to the frame pitch of the film 24.

Charging Exposure Section

Figure 8:
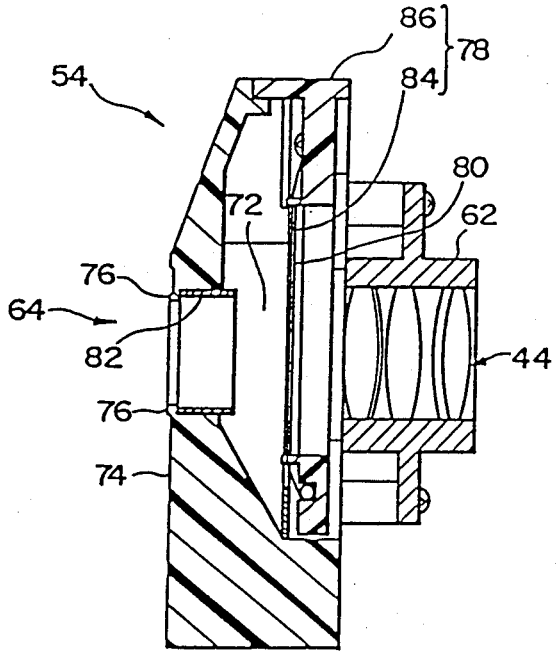
FIG. 8 is a sectional view taken along the line VIII—VIII in FIG. 6.

As shown in FIGS. 7 and 8, the charging exposure section 64 has a charging exposure chamber 72 which is defined by an internal space provided on the reverse side of a front wall 74 of the processing head 54. The chamber 72 is communincated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply which supplies a voltage of about +5 kV, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a pipe 87. The main lens 44, which is mounted on the rear side of the processing head 54 through the lens tube 62, has the optical axis thereof made coincident with the center of the opening defined by the mask 76.

Developing Section

As shown in FIGS. 5 and 6, the developing section 66 has a mask 90. The mask 90 is defined by an upper frame member 90A, left and right frame members 90B, 90C, and a lower frame member 90D. The upper frame member 90A and the left and right frame members 90B and 90C rise from the surface of a recess 92 formed in the front wall 74, and the lower frame member 90D rises from the front wall 74. Both longitudinal end portions of the lower frame member 90D project horizontally from the joints between the frame member 90D and the left and right frame members 90B and 90C. The amount by which the mask 90 projects is set so that the mask 90 is flush with the mask 76.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
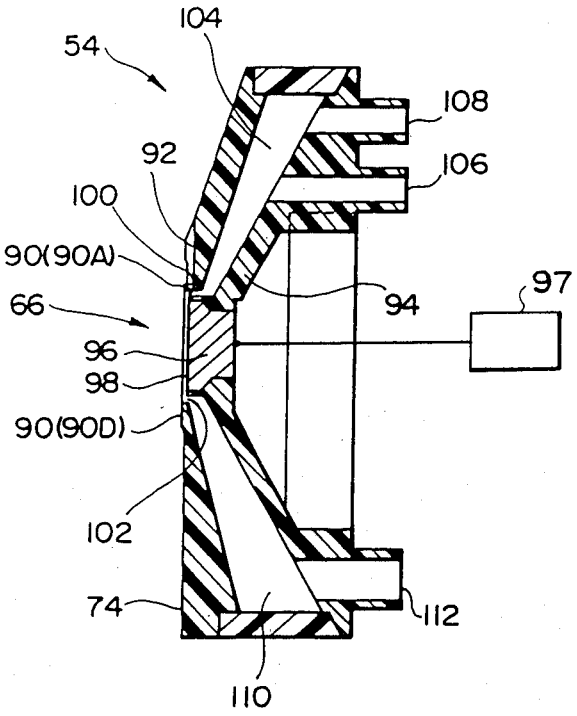
FIG. 9 is a sectional view taken along the line IX—IX in FIG. 6.
Figure 17A:
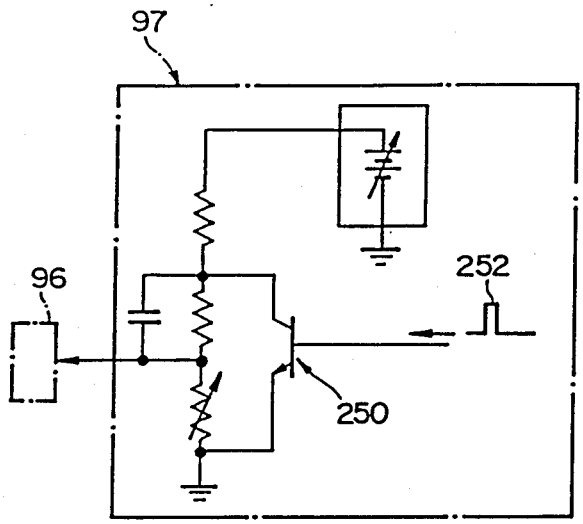
FIGS. 17(A) and 17(B) are circuit diagrams respectively showing examples of a bias power supply.

As shown in FIG. 9, a developing electrode 96 is disposed within the opening defined by the mask 90, the electrode 96 being supported by a rear wall 94. The developing electrode 96 is connected to a bias power supply 97. The bias power supply 97 has, for example, a circuit configuration such as that shown in FIG. 17(A). More specifically, the bias power supply 97 is arranged such that, when a switching transistor 250 is OFF, a predetermined DC bias voltage $V_1$ is generated, whereas, when the transistor 250 is ON, a pulse voltage $Vb_2$ which is opposite in polarity to the voltage $Vb_1$ is momentarily generated.

Figure 17B:
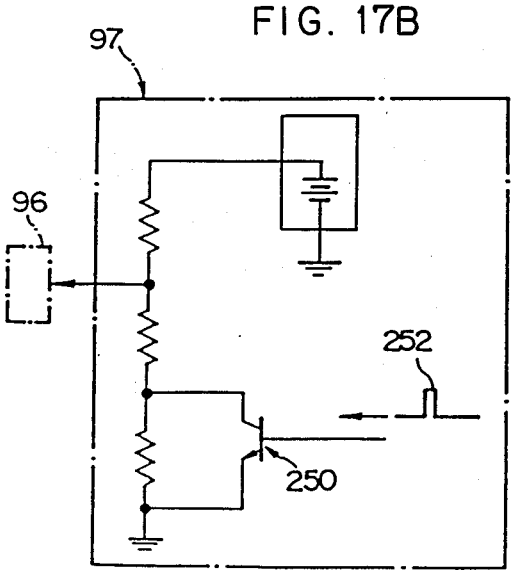

The bias power supply 97 may also have a circuit configuration such as that shown in FIG. 17(B). In this example, when the switching transistor 250 is OFF, a predetermined DC bias voltage $Vb_1$ is generated, whereas, when the transistor 250 is ON, a pulse voltage $Vb_2$ which has the same polarity as that of the voltage $Vb_1$ but is lower than it is momentarily generated.

The DC bias voltage $Vb_1$ is preferably set within a range from 80 V to 200 V DC, and the pulse voltage $Vb_2$ is preferably set within a range from 20 V to −200 V DC.

Figure 18:
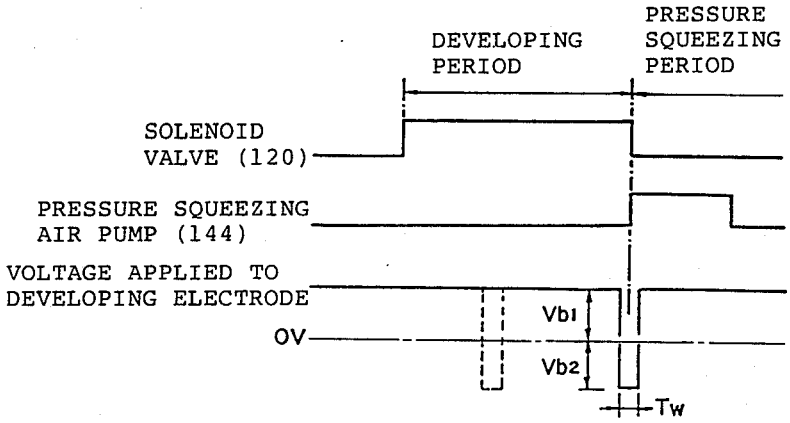
FIGS. 18 and 19 are charts each showing the timing at which two different bias voltages are switched over from one to the other.

The waveform of the output from the bias power supply 97 and the timing at which the pulse voltage $Vb_2$ is output therefrom are controlled as shown in FIG. 18 by controlling the timing at which a switching pulse 252 is applied to the base of the switching transistor 250. More specifically, the bias power supply 97 is controlled so as to supply a predetermined DC voltage $Vb_1$ during a period which begins at the time of starting a developing operation and which ends immediately before the completion of the developing operation, and the voltage $Vb_1$ is lowered to and maintained at the voltage $Vb_2$ during a period of time which begins immediately before the completion of the developing operation and which ends immediately after the starting of a pressure squeezing operation (described later), that is, a period of time which corresponds to a pulse width Tw. It should be noted that a pulse voltage $Vb_2$ may also be applied during the developing operation as shown by the broken line in FIG. 18.

In this embodiment, the bias voltage $Vb_1$ is set at +120 V, while the pulse voltage $Vb_2$ is set at −120 V, and the pulse width Tw of the pulse voltage $Vb_2$ is set at 30 msec.

The developing electrode 96 is positioned in such a manner that the outer surface thereof is located at a position which is about 300 μm inner than the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102.

The developer and squeezing air inlet 100 FIG. 9, is communicated with a passage 104 which is defined by a space inside the processing head 54. The passage 104 is communicated with a developer supply port 106 and a squeezing air supply port 108, which are provided in the rear side of the processing head 54. The developer and squeezing air outlet 102 is communicated with a passage 110 defined by a space inside the processing head 54. The passage 110 is communicated with a developer and squeezing air discharge port 112 which is provided in the rear side of the processing head 54.

Figure 10:
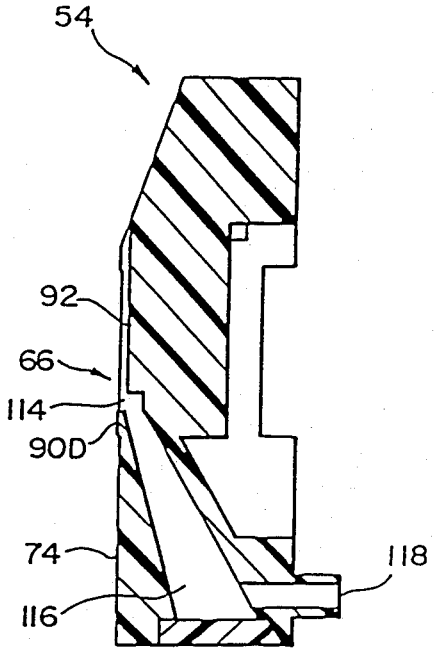
FIG. 10 is a sectional view taken along the line X—X in FIG. 6.

Recesses 92 are respectively provided on the outer sides of the left and right frame members 90B and 90C of the mask 90. As shown in FIGS. 6 and 10, a squeezing suction port 114 is provided at the lower end of each of the recesses 92. The suction ports 114 are, as shown in FIG. 10, communicated with a passage 116 which is defined by a space inside the processing head 54. The passage 116 is communicated with a suction squeeze opening 118 provided in the rear side of the processing head 54.

Referring to FIG. 11(A), the developer supply port 106 is connected to a developer tank 126 by pipes 122 and 124 through a solenoid valve 120 provided intermediate between the pipes 122 and 124. The developer tank 126 is positioned above the solenoid valve 120. The developer tank 126 is connected through a pipe 132 to a developer pump 130 activated by a motor 128, the pump 130 being disposed in a developer bottle 134. The developer bottle 134 contains a developer 136 formed by dispersing toner particles in a solvent.

The pipe 124, which connects together the solenoid valve 120 and the developer tank 126, is branched at the intermediate portion thereof to provide a return pipe 138 which opens into the developer bottle 134. In addition, a return pipe 140 which opens into the developer bottle 134 is connected to the developer tank 126.

The squeezing air supply port 108 is connected to a pressure squeezing air pump 144 through a pipe 142. The developer and squeezing air discharge port 112 is connected with a return pipe 146 which opens into the developer bottle 134.

As shown in FIG. 11(B), the suction squeeze opening 118 is connected to a suction trap 150 through a pipe 148. The suction trap 150 is connected to a suction squeezing air pump 154 through a pipe 152. A return pipe 156 which opens into the developer bottle 134 is connected to the bottom of the suction trap 150. A valve 158 which is able to close the return pipe 156 is disposed at the joint between the suction trap 150 and the return pipe 156. The valve 158 is moved vertically by the action of a solenoid 162 through a shaft 160.

Figure 11:
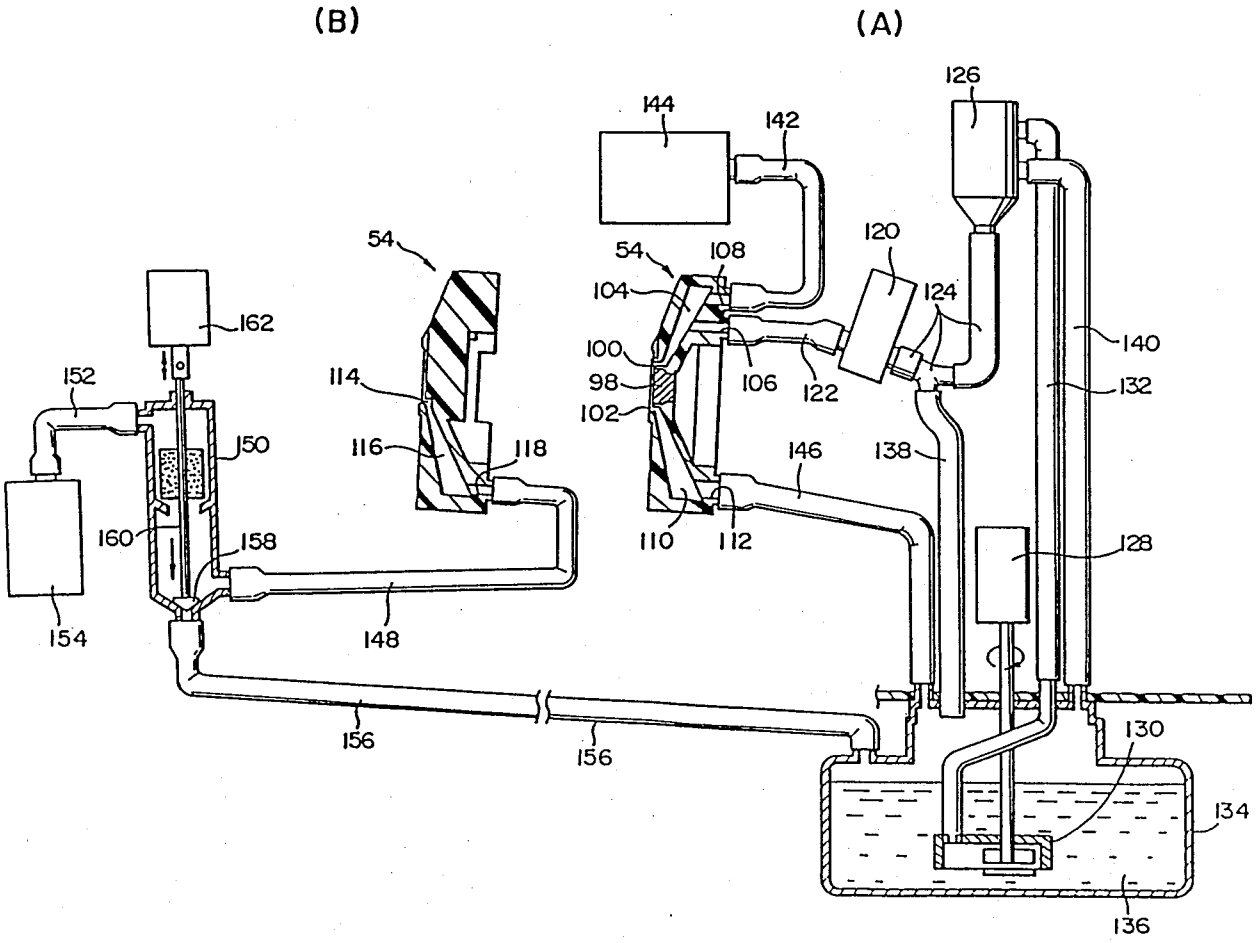
FIG. 11 shows the relationship between the developing section in the processing head and its associated devices.

It should be noted that, as shown in FIG. 11, the processing head 54 is inclined with respect to the horizontal plane so that the optical axis of each of the optical systems is perpendicular to the surface of the screen 16 which is slanted.

Drying Section

Referring to FIGS. 5 and 6, the drying section 68 has a frame 164. The frame 164 consists of an upper frame member 164A and left and right frame members 164B and 164C has no lower frame member. The left frame member 164B is contiguous with the right-hand end portion of the lower frame member 9D of the mask 90 and rises from the front wall 74 together with the upper frame member 164A. The right frame member 164C rises from a recess 168 which is depressed from the front wall 74 in the shape of a step.

Figure 12:
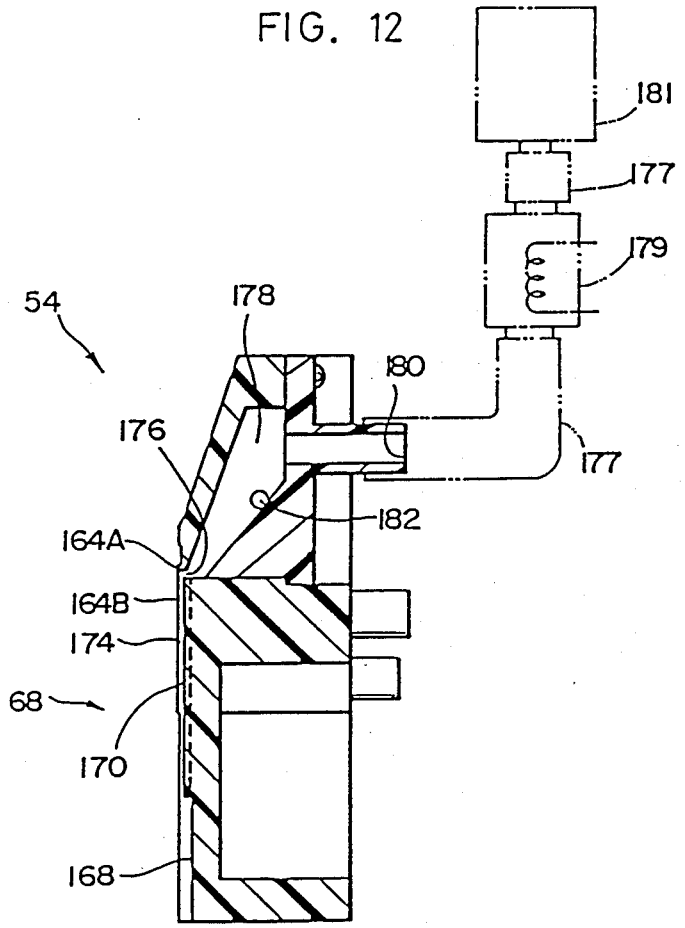
FIG. 12 is a sectional view taken along the line XII—XII in FIG. 6.

As shown in FIGS. 7 and 12, a wall 170 is formed between the left and right frame members 164B and 164C in such a manner that the surface of the wall 170 is located at a position which is slightly indented from the end face of the frame 164. In addition, recesses 172 are formed on both sides of the wall 170. The bottom surface of each recess 172 is raised from the wall surface of the recess 168 in the front wall 74. The space surrounded by the frame 164, the wall 170, and the recesses 172 defines a drying chamber 174. The distance between the opposing lateral inner surfaces of the frame 164 is set such as to be larger than the width of the opening defined by the mask 90. In addition, the lower surface (the frame inner surface) of the upper frame member 164A is positioned above that of the mask 90 in the developing section 66.

As shown in FIGS. 6 and 12, the lower portion of the upper frame member 164A is cut in the shape of a slit along the longitudinal direction of the frame member 164A, thereby providing a warm air outlet 176. The warm air outlet 176 is, as shown in FIG. 12, communicated with a passage 178 which is defined by a space inside the processing head 54. The passage 178 is communicated with a warm air supply port 180 which is provided in the rear side of the processing head 54. A temperature sensor 182 is disposed in the passage 178. The warm air supply port 180 is connected to a heater 179 and an air pump 181 through a pipe 177.

Fixing Section

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 13:
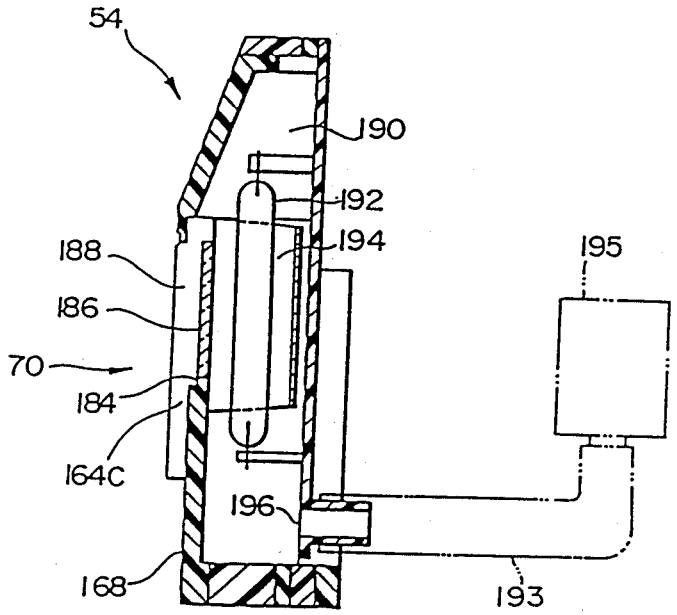
FIG. 13 is a sectional view taken along the line XIII—XIII in FIG. 6.

As shown in FIG. 13, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a pipe 193. The space 190 and the fixing chamber 188 are communciated with each other through the area defined at the upper edge of the glass plate 186.

Blip Sensor

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

Film Pressing Mechanism

Figure 14:
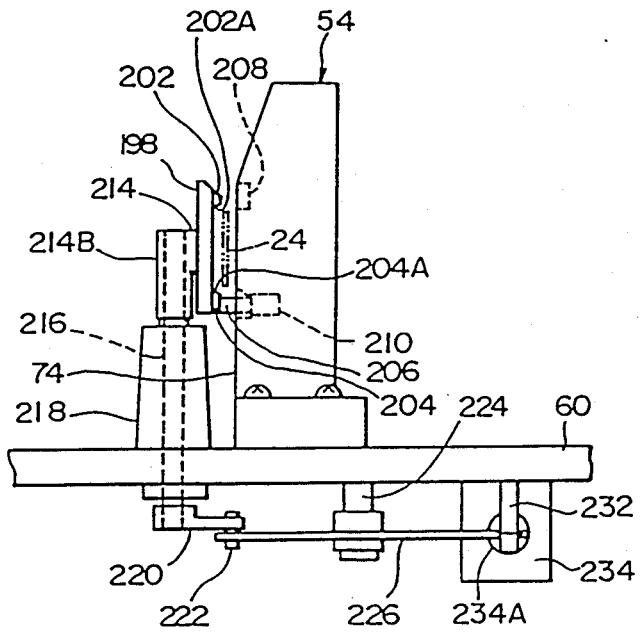
FIG. 14 is a schematic side view showing the positional relationship between the processing head and a pressing plate.

As shown in FIGS. 7 and 14, a pressing plate 198 is disposed in front of the front wall 74 of the processing head 54. The pressing plate 198 is, as shown in FIG. 15, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 15A:
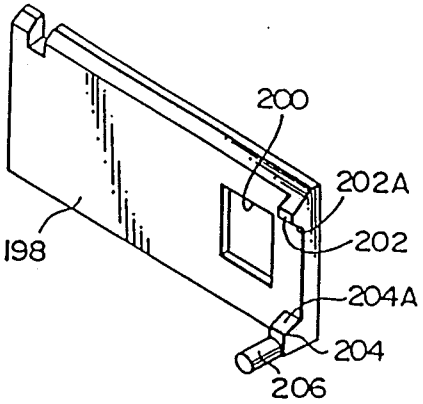
FIG. 15A is a perspective view of one of the elements shown in FIG. 15, as viewed from the opposite side.
Figure 15:
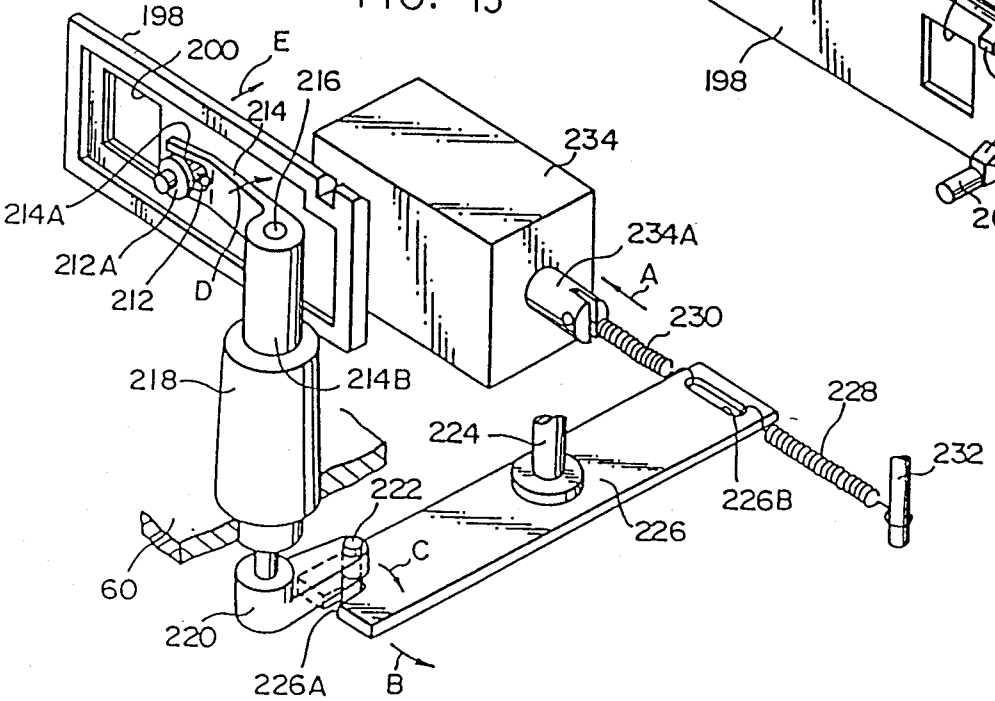
FIG. 15 is a perspective view of a film pressing mechanism disposed on the processing head.

As will be clear from FIG. 15A (a perspective view of the pressing plate 198 shown in FIG. 15, as viewed from the opposide side), the pressing plate 198 has fitting members 202 and 204 respectively formed on the upper and lower end portions on the side of the plate 198 which is closer to the through-hole 200, the fitting members 202 and 204 projecting toward the processing head 54. The opposing inner surfaces of the fitting members 202 and 204 ar slanted as at 202A and 204A. The distance between the respective root portions of the upper and lower fitting members 202 and 204 is set such as to be equal to the width of the electrophotographic film 24 (strictly speaking, said distance being slightly larger than the width of the film 24), as shown in FIG. 14. A columnar portion 206 projects from the distal end of the fitting member 204. The fitting members 202 and 204 are able to be fitted into bores 208 and 210, respectively, formed in the front wall 74 of the processing head 54, as shown in FIGS. 5, 6 and 14.

The pressing plate 198 has a columnar portion 212 projecting from the reverse surface thereof, that is, the surface thereof which is remote from the processing head 54. This columnar portion 212 is engaged with a notched portion 214A formed at one end portion of an arm 214. A stop ring 212A is rigidly secured to the distal end portion of the columnar portion 212 so as to prevent the notched portion 214A from coming off the columnar portion 212. A boss portion 214B is formed at the other end of the arm 214. A shaft 21 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 220 is rigidly secured to the projecting lower end portion of the shaft 216. A pin 222 is rigidly secured to the distal end portion of the first lever 220.

A shaft 224 is suspended from the reverse side of the frame 60. The shaft 224 pivotally supports the intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the springs 228 and 230 biasing the second lever 226 in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210 as shown in FIG. 14.

When the solenoid 234 is energized, the plunger 234A is activated to move in the direction of the arrow A, FIG. 15, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so as to press the pressing plate 198 in the direction of the arrow E.

The pressing plate 198 is moved in the direction of the arrow E while the columnar portion 206 is being guided by the bore 210, thus causing the film 24 to be pressed against the end faces of the masks 76, 90 and the frame 164. When the heightwise position of the film 24 is misaligned, the respective slanted surfaces of the fitting members 202 and 204 act so as to push down the upper edge of the film 24 or push up the lower edge thereof as the pressing plate 198 is moved in the direction of the arrow E.

When the pressing plate 198 is pressing the film 24 against the processing head 54, the fitting members 202 and 204 are respectively fitted in the bores 208 and 210, so that the film 24 is accurately positioned with respect to the processing head 54. In this state, the pressing plate 198 is allowed to resiliently pres the film 24 by the action of the tension coil springs 228 and 230.

When the solenoid 234 is de-energized, the second lever 226, which is subjected to the biasing force from the spring 228, is pivoted counter to the direction of the arrow B. In consequence, the arm 214 is pivoted counter to the direction of the arrow D, so that the notched portion 214A presses the stop ring 212A, causing the pressing plate 198 to move counter to the direction of the arrow E.

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26 is locked at said position. In this state, the film 24 is positioned as shown in FIG. 14 and is allowed to move along the front side of the processing head 54 by the operation of a film moving motor (not shown).

When the image of the document 34 (shown in FIG. 2) is to be recorded on the film 24, the film moving motor is activated to move the film 24 in such a manner that a given frame which is selected from the unexposed frames as desired is positioned in front of the mask 76 in the charging exposure section 64. This operation is executed by designating a desired frame through the control keyboard 28 shown in FIG. 1. The positioning of the selected frame with respect to the charging exposure section 64 is effected by virtue of the blip sensor 196 which counts the number of blip marks 24A from a reference point.

Figure 16:
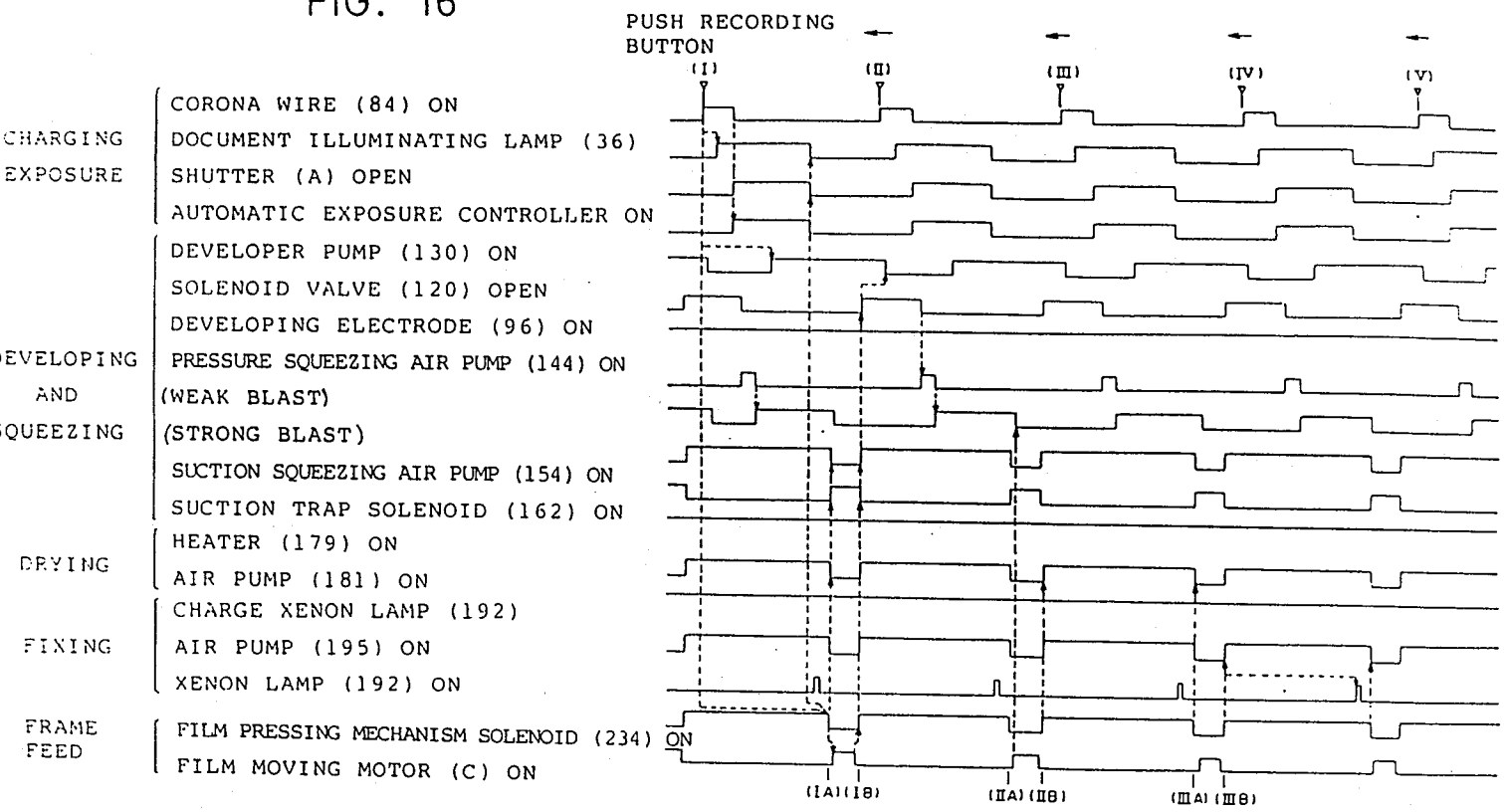
FIG. 16 is a time chart showing various operations of the electrophotographic apparatus in the camera mode.

FIG. 16 is a time chart showing the operation of the apparatus in the case where a given frame is positioned as described above and subjected to recording and, subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) in FIG. 16 to start recording.

Recording of the document 34 is made possible by selecting the camera mode through the control keyboard 28. Simultaneously with this mode selecting operation, a bias voltage is applied to the developing electrode 96 in the developing section 66 (see FIG. 18), the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 2 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so as to be in pressure contact with the respective end faces of the masks 76, 90 and the frame 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at the position (I) in FIG. 16, so as to illuminate the document 34 placed on the glass plate 22 of the document table 18. Further, when a predetermined period of time has elapsed after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 16) is opened, and the light reflected from the document 34 placed on the document table 18 is applied to the film 24 by the optical system shown in FIG. 2. In addition, the automatic exposure controller (not shown but indicated by the reference symbol B in FIG. 16) simultaneously starts integration of the quantity of light.

On the other hand, when a predetermined period of time has elapsed after the recording button has been pressed, the motor 128 shown in FIG. 11(A) is activated to start the operation of the developer pump 130, whereby the developer 136 in the developer bottle 134 is pumped up into the developer tank 126. The developer 136 in the tank 126 gravitationally lowers and passes through the pipe 124 toward the processing head 54. However, since the solenoid valve 120 has not yet been opened at that time, the developer 136 is returned to the developer bottle 134 through the return pipe 138. When the level of the developer 136 in the tank 126 excessively rises, the developer 136 is returned to the developer bottle 134 through the return pipe 140.

In this way, until the solenoid valve 120 is opened, the developer 136 circulates between the developer bottle 134 and the developer tank 126, and while doing so, the developer 136 stands by at a position immediately before the solenoid valve 120. This circulation cause the developer 136 in the developer bottle 134 to be stirred.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed and, one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controlled (B), an optimal exposure operation is effected at all times.

When a predetermined period of time has elapsed after the recording button has been pressed and all the steps of processing other frames have already been completed, the solenoid 234 of the film pressing mechanism is immediately de-energized. When the solenoid 234 is de-energized at the position (IA) in FIG. 16, the pressing plate 198 is separated from the film 24.

At the same time as the solenoid 234 of the film pressing mechanism is de-energized, the solenoid 162 of the suction trap 150 shown in FIG. 11(B) is energized to raise the valve 158 through the shaft 160, thus allowing the return pipe 156 to be communicated with the suction trap 150. In consequence, the developer 136 which has been trapped by the suction trap 150 during the previous developing and squeezing step (described later) is returned to the developer bottle 134.

When a predetermined period of time has elapsed after the solenoid 234 of the film pressing mechanism has been de-energized, the film moving motor (not shown but indicated by the reference symbol C in FIG. 16) is activated to move the film 24 rightwardly as viewed in FIG. 6 by a distance corresponding to one frame. Thus, the frame which has been positioned at the charging exposure section 64 is moved to the developing section 66. The movement of the film 24 by one frame is controlled by the blip sensor 196 in a manner similar to the above. More specifically, the movement of the film 24 is suspended when the sensor 196 detects a subsequent blip mark 24A.

When a predetermined period of time has elapsed after the film moving motor (C) has been suspended, the solenoid 234 of the film pressing mechanism is energized at the position (IB) in FIG. 16, so that the film 24 is pressed against the processing head 54 by the pressing plate 198. At the same time, the solenoid 162 of the suction trap 150 is de-energized so as to close the return pipe 156, and the suction squeezing air pump 154 is activated. In addition, the solenoid valve 120 is opened.

When the solenoid valve 120 is opened, the developer 136 is allowed to reach the processing head 54 through the pipe 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, adhere to portions of the film 24 which are charged positive, thereby developing the electrostatic latent image. The developer 136 having flowed down through the developing chamber 98 is returned to the developer bottle 134 from the developer and squeezing air outlet 102 through the return pipe 146.

The diameter or the like of each of the pipes is set so that a part of the developer 136 supplied to the pipe 124 from the developer tank 126 is returned to the developer bottle 134 through the return pipe 138, and the remaining developer 136 advances toward the solenoid valve 120.

Since the film 24 is pressed against the end face of the mask 90 by virtue of the pressing plate 198, substantially no developer 136 enters the gap between the end face of the mask 90 and the film 24 when the developer 136 flows down through the developing chamber 98. Any developer 136 which enters said gap is sucked and trapped into the suction trap 150 from the squeeze suction port 114 through the pipe 148 by means of a vacuum produced in each of the recesses 92 which are respectively located on the outer sides of the left and right frame members 90B and 90C of the mask 90, the vacuum being produced by the action of the suction squeezing air pump 154.

When a predetermined period of time has elapsed after the solenoid 234 of the film pressing mechanism has been energized, the drive of the motor 128 is suspended, and the operation of the developer pump 130 is consequently suspended. However, the solenoid valve 120 remains opened thereafter. Since the developer 136 is gravitationally supplied from the developer tank 126 to the processing head 54, even when the operation of the developer pump 130 is suspended, the supply of the developer 136 to the developing chamber 98 is continued. It is therefore possible to minimize possible exposure blur which may be caused by vibrations of the developer pump 130 during the exposure of a subsequent frame.

When a predetermined period of time has elapsed after the solenoid valve 120 has been opened, the valve 120 is closed to suspend the supply of the developer 136 to the developing chamber 98. At the same time, the pressure squeezing air pump 144 shown in FIG. 11(A) is activated to supply pressurized air to the developing chamber 98 from the developer and squeezing air inlet 100, whereby surplus developer 136 attached to the film 24 is blown off so as to be swished off. The developer 136 thus blown off is returned to the developer bottle 134 from the developer and squeezing air outlet 102 through the return pipe 146.

The supply of the pressurized air to the developing chamber 98 is controlled in such a manner that a relatively weak blast is applied while a relatively large amount of developer 136 remains in the developing chamber 98 in order to prevent deterioration of the quality of the image which would otherwise be caused by an operation of blowing off the developer 136 at high speed. When a predetermined period of time has elapsed after the application of the blast has been started, a relatively strong blast is applied to increase the squeezing efficiency.

The application of the blast is controlled by the charging exposure step for a subsequent frame which has been started in response to the pressing of the recording button at the position (II) in FIG. 16. The application of the blast is suspended at the same time as the drive of the film moving motor (C) is started at the time when a predetermined period of time has elapsed after the solenoid 234 of the film pressing mechanism has been de-energized at the position (IIA) in FIG. 16, thus completing the developing and squeezing step.

It should be noted that the presence of the developing electrode 96 during the developing operation enables obtaining of an image having no edge effect. In addition, the application of a bias voltage to the developing electrode 96 prevents fogging of the image. Further, the bias voltage applied to the developing electrode 96 is, as shown in FIG. 18, momentarily lowered for a period of time which begins immediately before the completion of the developing operation and which ends immediately after the starting of the pressure squeezing operation, and therefore the electric field is momentarily intensified during said period. This leads to an increase in the amount of toner particles which contribute to development particularly at the upper region (the region positioned on the upstream side as viewed in the direction of flow of the developer 136) of a portion of the frame which is to be a solid half-tone portion of the developed image. Accordingly, a sufficient amount of toner particles adheres to said portion, and the image density of the solid half-tone portion is thereby made uniform.

In addition to this action, the reproducibility of a thin-line pattern and a character around a solid half-tone image is also improved. It should be noted that, since the period of time during which the bias voltage is maintained at a lowered level is relatively short, there is no fear of an image being fogged.

When the drive of the film moving motor (C) is suspended, the film 24 has been moved rightwardly as viewed in FIG. 6 by an amount corresponding to one frame, so that a frame which has been positioned at the developing section 66 is now positioned at the drying section 68. When a predetermined period of time has elapsed after the drive of the film moving motor (C) has been suspended, the solenoid 234 of the film pressing mechanism is energized at the position (IIB) in FIG. 16 and, at the same time, the air pump 181 shown in FIG. 12 is activated. In consequence, the air heated by the heater 179 is blown into the drying chamber 174 from the warm air outlet 176 in the drying section 68, and the developer 136 is thereby dried. The operation of the air pump 181 is controlled by the charging exposure step which is started when the recording button is pressed at the position (III) in FIG. 16, and suspended at the same time as the solenoid 234 of the film pressing mechanism is de-energized at the position (IIIA) in FIG. 16, thus completing the drying step.

The temperature of the warm air which is supplied to the drying chamber 174 is detected by the temperature sensor 182, and when the temperature is out of a predetermined range, this fact is displayed on the control keyboard 28. When the temperature of the warm air is excessively high, the supply of current to the heater 179 is immediately suspended.

Although in the above-described embodiment the drying air pump 181 is activated in response to the energization of the solenoid 234 of the film pressing mechanism and only when the film 24 is being pressed against the processing head 54, the air pump 181 may be operated at all times from the start of the operation of the apparatus.

After the solenoid 234 of the film pressing mechanism has been de-energized at the position (IIIA) in FIG. 16, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) in FIG. 16 and, at the same time, the air pump 195 shown in FIG. 13 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such matter adhering to the surface of the glass plate 186.

When the above-described steps are finished, the recording of an image on the electrophotographic film 24 is completed.

In the apparatus according to this embodiment, when the recording button is pressed, recording is started, and after the recorded frame positioned at the charging exposure section 64 has been moved to the developing section 66 and when a predetermined period of time has elapsed after the solenoid 234 of the film pressing mechanism has been energized, it becomes possible to record a subsequent frame. To effect continuous recording of following consecutive frames, the recording button is pressed during the period which begins when it becomes possible to record a subsequent frame and which ends when a predetermined period of time has elapsed after the completion of the application of a relatively weak blast to the developing section 66 by the pressure squeezing air pump 144. In consequence, the recording step is repeated, and the processing proceeds as shown in FIG. 16.

When the recording button is not pressed during said period, or when the command to end a series of recording operations is input from the control keyboard 28, the application of a relatively strong blask by the air pump 144 is suspended in accordance with the operation of a timer, and the drying and fixing operations carried out thereafter are also executed in accordance with the timer.

When the reader mode is selected, it is possible to project the film 24 having images of documents recorded thereon as described above. The electrophotographic apparatus in accordance with this embodiment is arranged such that, when a cassette is loaded in the same way as the above, the reader mode is automatically selected (the third mirror 38 has already been moved from the position shown in FIG. 2 to another position). When a given frame is moved to and stopped at the charging exposure section 64 by an operation similar to the above, the light source of the projecting light source section 46 shown in FIG. 3 is turned ON. The light from the light source is passed through the through-hole 200 provided in the pressing plate 198 and transmitted by the film 24, and the image recorded on the film 24 is enlarged and projected o the screen 16 by the optical system shown in FIG. 3.

At the same time as the light source is turned ON, the air pump 89 shown in FIG. 7 is activated to supply cold air to the charging exposure chamber 72 so as to cool the film 24, thereby preventing the film 24 from being heated to high temperature by the heat from the projecting light source section 46, and thus avoiding any out-of-focus problem due to thermal deformation of the film 24.

In the reader mode, it is possible to continuously view projected images of the film 24 within a short period of time by successively advancing the film 24 for each frame through the control keyboard 28. In such case, every time the film 24 is moved, the shutter (A) is closed in order to prevent flickering due to persistence phenomenon.

When the copy button on the control keyboard 28 is pressed while an image is being projected on the screen 16, the copy mode is selected. In consequence, the copy mirror 52 is moved, and the image being projected on the screen 16 is recorded on a sheet of copying paper 30 by the optical system shown in FIG. 4.

Figure 20:
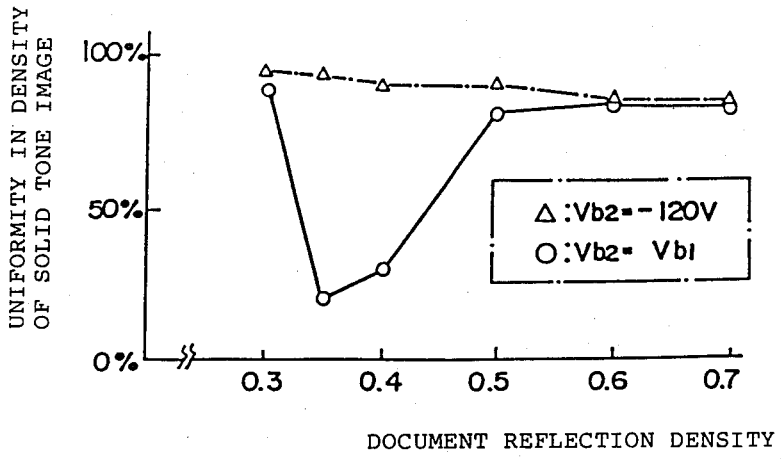
FIGS. 20 to 22 are graphs employed to describe advantages offered by the embodiment of the present invention.

FIG. 20 shows one practical example displaying advantageous effects of this embodiment on solid half-tone images. The graph of FIG. 20 shows the results of measurement of uniformity in image density of various solid tone images formed by recording documents respectively having solid tone patterns in the shape of a square of 1.5 cm×1.5 cm and with different document reflection densities by the use of the process in accordance with this embodiment.

The symbol ○ in the figure denotes comparative examples formed by a developing process without any lowering of the bias voltage $Vb_1$ (120 V). As will be clear from the graph, the uniformity in density of the solid tone images is lowered in a solid half-tone region at a document reflection density range from 0.3 to 0.5. This is, as described above, attributable to the fact that, because of a relatively low potential at the solid half-tone portion of each latent image, the speed at which toner particles are attracted so as to adhere to said portion is relatively low and therefore it is difficult for toner particles to adhere to the upstream region of the solid half-tone portion as viewed in the direction of the flow of the developer. The symbol Δ in the graph denotes examples obtained by the process according to the present invention in which the bias voltage $Vb_1$ (120 V) is momentarily lowered to the voltage $Vb_2$ (−120 V). In these examples, the degree of uniformity in density of the solid tone images is sufficiently high even in the solid half-tone region, and substantially no unevenness is found therein.

Figure 21:
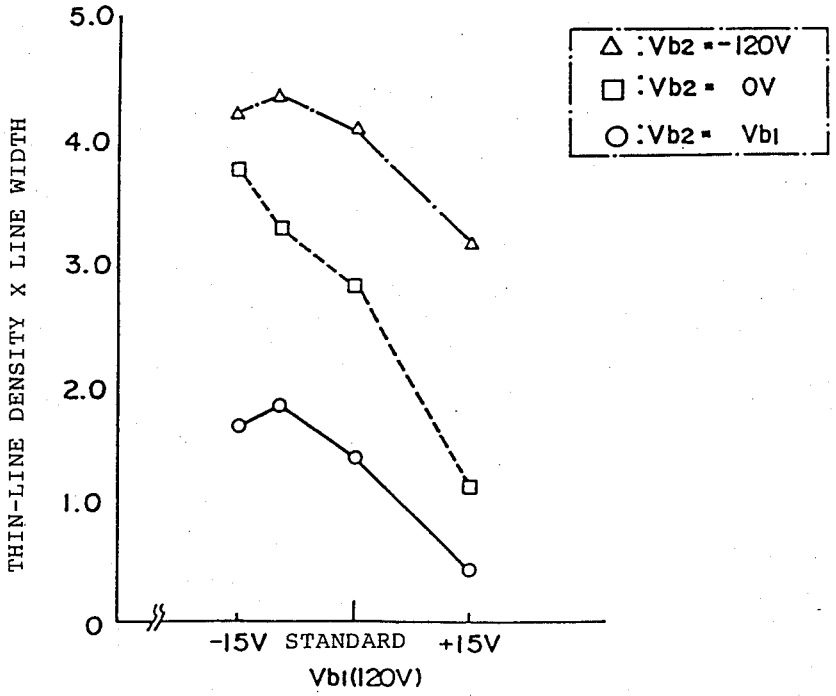

FIG. 21 shows one example displaying the effect of this embodiment on thin-line images. The graph of FIG. 21 shows the relationship between the product of the thin-line density and line width of each of the thin-line images and the bias voltage $Vb_1$, the thin-line images being formed by recording documents having thin-line patterns with a line width of 100 μm by the use of the process shown in the described embodiment, and the bias voltage $Vb_1$ being varied in the vicinity of a standard point (120 V).

The symbol ○ in the graph denotes comparative examples obtained by a developing process without, any lowering of the bias voltage $Vb_1$. The symbols Δ and □ denote examples formed by the developing process in accordance with the embodiment of the present invention, the examples Δ and ⌉ being obtained by lowering the bias voltage $Vb_1$ to the voltage $Vb_2 = -120$ V and to the voltage $Vb_2 = 0$ V, respectively.

As will be clear from the results shown in FIG. 21, the developing method in accordance with the described embodiment of the present invention enables the reproducibility of thin-line images to be considerably improved.

As described above, in this embodiment the bias voltage applied to the developing electrode 96 is momentarily lowered to a voltage opposite in polarity to this bias voltage, and therefore the image density of solid half-tone portions is made uniform. In addition, the reproducibility of a thin-line pattern and a character around a solid half-tone image is also improved. The bias voltage may be lowered not only to a voltage opposite in polarity to the bias voltage but also to a voltage which has the same polarity as that of the bias voltage but is lower than it.

Figure 22:
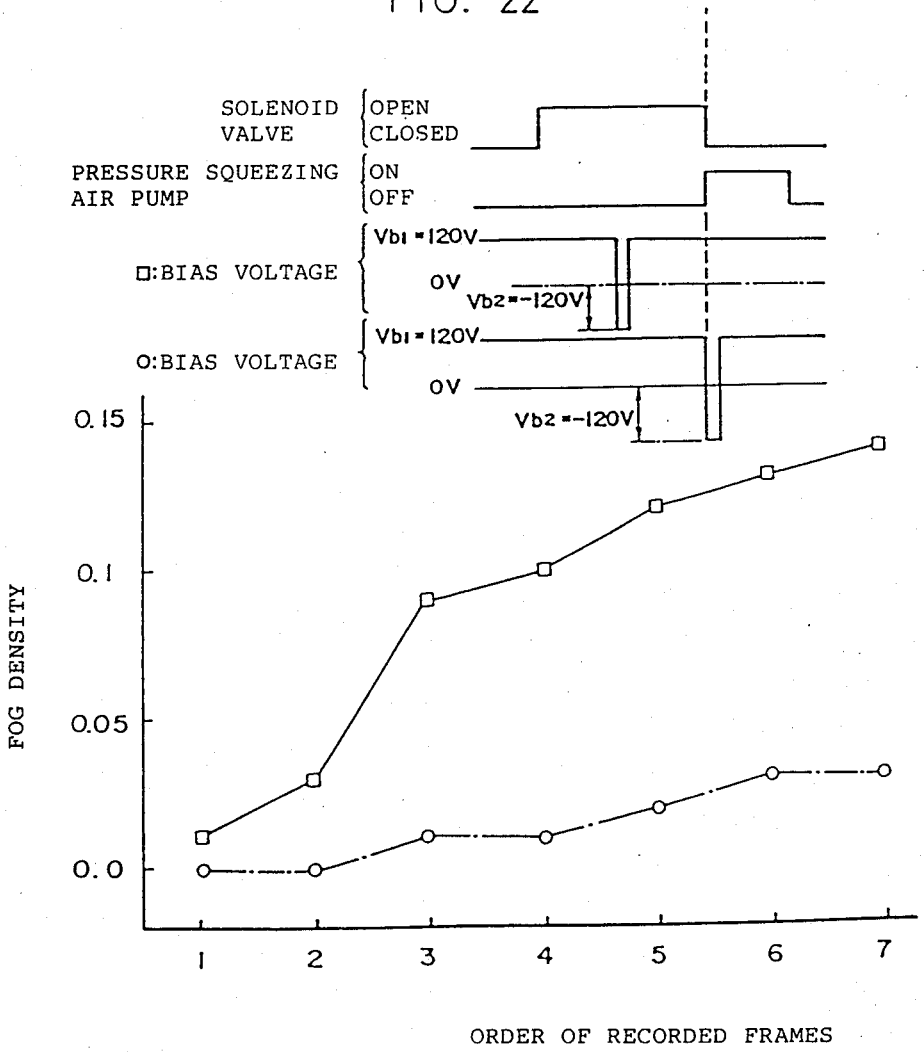
Figure 23:
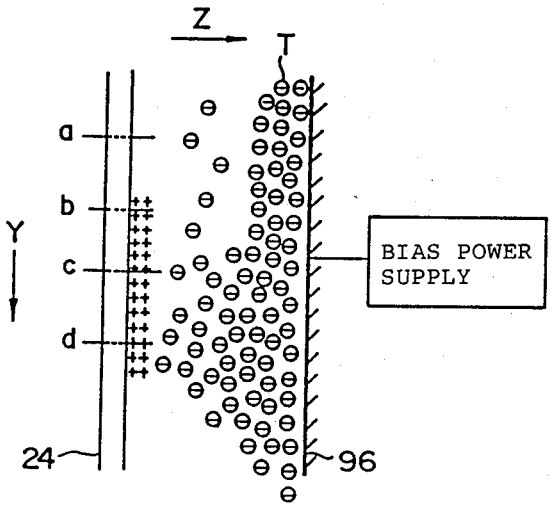
FIG. 23 is a schematic view employed to describe the action of the present invention.
Figure 24:
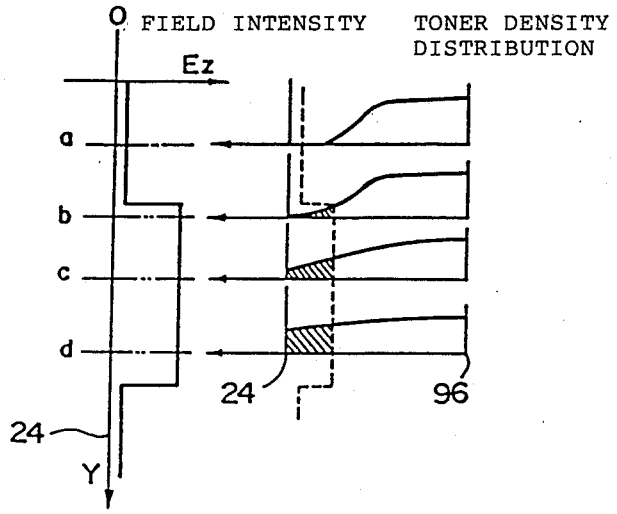
FIGS. 24(A) to 24(C) are charts showing the relationship between the field intensity and the toner density distribution, which are employed to describe the action of the present invention.
Figure 24B:
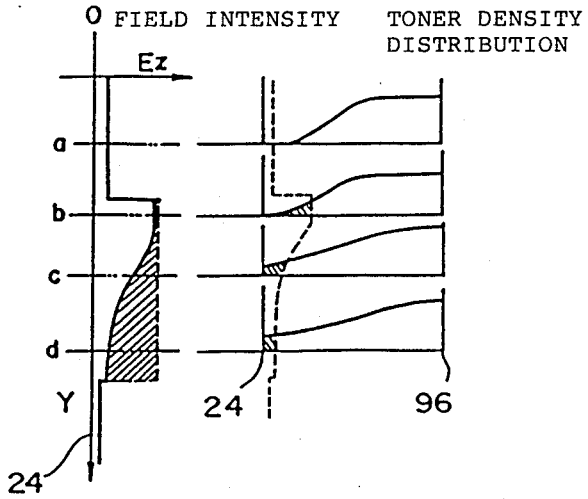
Figure 24C:
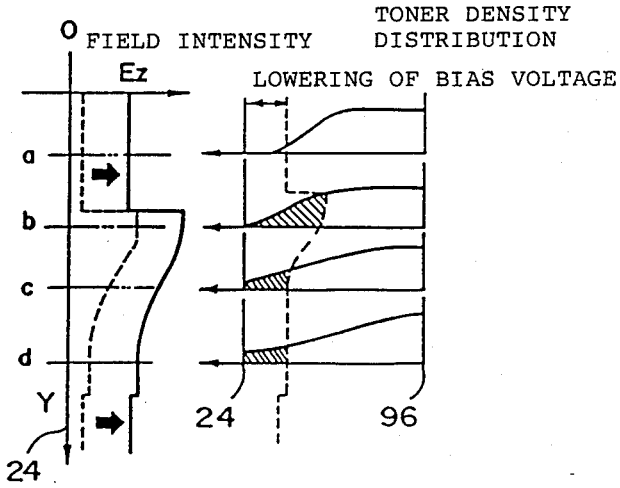

FIG. 22 shows the way in which the fog density of images changes when a continuous recording operation is conducted by the process in accordance with the above-described embodiment. The symbol □ in the graph represents comparative example obtained by momentarily lowering the bias voltage only during the developing period. The fog density is slightly increased by the momentary lowering of the bias voltage. Therefore, in order to cancel the increase in the fog density, the bias voltage in this example is set so as to be slightly higher than that in the case where the bias voltage is not momentarily lowered. Accordingly, a first recorded frame which is not affected by the development of a previous frame has a clear and fine finished image having substantially no fog. However, frames which follow the first frame are gradually increased in the fog density. This is attributable to the fact that the application of a relatively high bias voltage allows toner particles to readily adhere to the developing electrode and the electric charge o the toner particles adhering to the developing electrode undesirably weakens the fogging preventing electric field which is applied by the developing electrode. Accordingly, it is inappropriate to lower the bias voltage only during a developing operation when a continuous recording process is carried out as in the case of the described embodiment.

On the other hand, the symbol ○ denotes examples obtained by the process according the present invention in which the bias voltage is momentarily lowered for a period of time which begins immediately before the completion of each developing operation and which ends during the following pressure squeezing period. As will be clear from FIG. 22, the increase in fog density is extremely small in the case of a continuous recording operation also. This is attributable to the fact that, when the bias voltage is momentarily lowered, an electric field is produced which acts in a direction in which toner particles are moved away from the developing electrode, thus causing a part of the toner particles adhering to the developing electrode to be separated therefrom, and at this time, a pressure squeezing operation is carried out to discharge the developer; therefore, the amount of toner particles accumulated on the developing electrode is remarkably reduced.

In the case of such bias voltage lowering timing also, there are noticeable improvements in the uniformity in density at a solid half-tone portion of a developed image and in the reproducibility of a thin-line pattern.

When the bias voltage is lowered at the above-described timing, the lowering of the bias voltage is preferably carried out within a range from 100 msec before the completion of a developing operation to 80 msec after the starting of a pressure squeezing operation. If the lowering of the bias voltage is started before this period of time, the fog density is readily increased in a continuous recording operation, and if the bias voltage is kept lowered beyond said period, uneven squeezing is readily caused.

It should be noted that, although in the above-described embodiment the bias voltage applied to the developing electrode is momentarily lowered in a predetermined cycle, the lowering of the bias voltage may be carried out at irregular intervals. In such case, if the lowering of the bias voltage is effected at least once in a predetermined period, satisfactory effects are obtained.

Although in the above-described embodiment the lowering of the bias voltage is effected by a circuit (shown in FIG. 17) which employs a transistor, other types of electric circuit may be employed to lower the bias voltage, and in such case it is also possible to obtain advantages equal to those which are offered by the described embodiment.

Although a pulse having a rectangular waveform is employed to lower the bias voltage in the above-described embodiment, such pulse is not necessarily limitative, and the bias voltage may be lowered in response to a saw-tooth or sine-wave pulse to obtain advantages equal to those offered by the described embodiment.

Figure 19:
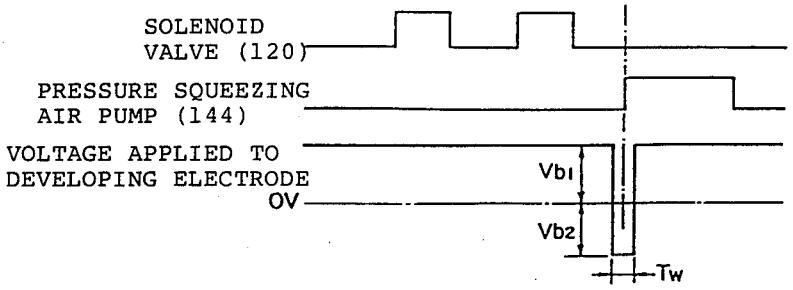

In the above-described embodiment, the developer 136 is continuously supplied to the developing chamber 98. However, if the developer 136 is intermittently supplied as shown in FIG. 19 by controlling the solenoid valve 120 during development, the above-described advantageous effects are further improved. In such case, the bias voltage may be lowered either when the developer 136 is flowing or when the developer 136 is at rest.

Further, although in the above-described embodiment the developer 136 is passed through the developing chamber 98 by means of gravity drop, the developer 136 may be pumped by, for example, a pressure pump. In this case, the rate of flow of the developer 136 can be increased, so that the developer 136 is refreshed even more effectively.

As has been described above, the present invention provides a method of developing an electrophotographic film using a liquid developer wherein a bias voltage applied to an electrode disposed in opposing relation to the film which is electrically charged is switched over at least once to either a voltage which is opposite in polarlity to the charged film or a voltage which has the same polarity as that of the charged film and is lower than the bias voltage. It is therefore possible to make uniform the density of a solid half-tone portion of a developed image and to improve the reproducibility of a thin-line pattern.

In addition, it is possible to obtain images having no fogging even in a continuous recording operation by switching over the bias voltage to said voltage during a period of time which begins immediately before completion of a developing operation and which ends immediately after the starting of a pressure squeezing operation.

Although the present invention has been described through specific terms, it should be noted here that the described embodiment is not necessarily exclusive and various changes and modifications may be imparted thereto without departing from the scope of the invention which is limited solely by the appended claims.

What is claimed is:

1. A method of developing an electrophotographic film wherein a liquid developer is supplied to a gap defined between a photosensitive layer side of said film that is electrically charged and an electrode disposed in opposing relation to said photosensitive layer side, and a bias voltage of the same polarity as that of said charged film is applied to said electrode to develop said film, said method lasting for a predetermined period of time and comprising:

maintaining, for most of said predetermined time, said bias voltage substantially at a first voltage for causing an electric field to emanate from said photosensitive layer side of said film to cause developer to adhere to said photosensitive layer side, and switching over said bias voltage at least once for a short period of time relative to said predetermined time to a second voltage for improving adhesion of said developer to a portion of said photosensitive layer side having a relatively low density.

2. A method according to claim 1, wherein said bias voltage is switched over to and maintained at said second voltage during a pressure squeezing operation which is conducted for discharging said developer after a developing operation has been completed.

3. A method according to claim 1, wherein said bias voltage is switched over to and maintained at said second voltage during a period which begins immediately before completion of a developing operation and which ends during a pressure squeezing operation.

4. A method according to claim 3, wherein the period of time during which said bias voltage is switched over to and maintained at said second voltage ranges from 100 msec before completion of a developing operation to 80 msec after the starting of a pressure squeezing operation.

5. A method according to claim 1, wherein said liquid developer is supplied by means of either gravity drop or pumping.

6. A method according to claim 1, wherein said liquid developer is intermittently supplied.

7. A method according to claim 1, wherein the period of time during which said bias voltage is switched over to and maintained at said second voltage is shorter than a period of time beyond which the lower density begins to change.

8. A method according to claim 7, wherein the period of time during which said bias voltage is switched over to and maintained at said second voltage ranges from 10 msec to 200 msec.

9. A method according to claim 1, wherein said bias voltage is lowered with a rectangular waveform.

10. A method as claimed in claim 1, wherein said second voltage is opposite in polarity to said charged film.

11. A developing apparatus wherein a developer is supplied to an image formed on an electrophotographic film by light exposure to develop said image, said apparatus comprising:

(a) an electrode disposed in opposing relation to a photosensitive layer side of said film;

(b) supply means for supplying said developer to an area defined between said electrode and said film; and (c) a power supply including means for applying a bias voltage of same polarity as the electrically charged polarity of said film to said electrode, means for making said developer effectively adhere to a relative low density portion of said image on said electrophotographic film including means for switching over said bias voltage to a second voltage, and means for maintaining said second voltage for a relatively short period of time.

12. A developing apparatus according to claim 11, wherein said bias voltage is switched over using switching means which momentarily changes said bias voltage.

13. A developing apparatus according to claim 12, wherein said switching means is defined by a transistor.

14. A developing apparatus according to claim 13, wherein a switching pulse which is applied to a base terminal of said switching transistor has a rectangular waveform.

15. A developing apparatus wherein an image which has been formed on an electrophotographic film by light exposure is developed by means of a developer, said apparatus comprising:

(a) a processing head provided with a developing section in the shape of a recess for developing said film;

(b) driving means for successively feeding a plurality of frames on said film which are to be developed so that each frame faces said developing section;

(c) pressing means for pressing said film in order to allow each frame to face said developing section;

(d) an electrode provided in said developing section so as to face said film; and (e) voltage supply means including means for applying a bias voltage of the same polarity as that of said film that is electrically charged to said electrode, thereby preventing a white ground portion of said image from fogging, means for allowing said developer to effectively become well adhered to a relatively low density portion of said image, including means for switching over said bias voltage to a second voltage at least once for a relatively short period of time.

16. A developing apparatus according to claim 15, wherein said bias voltage is switched over using switching means which momentarily changes said bias voltage.

17. A developing apparatus according to claim 16, wherein said switching means is defined by a transistor.

18. A developing apparatus according to claim 17, wherein a switching pulse which is applied to a base terminal of said switching transistor has a rectangular waveform.

19. A developing apparatus according to claim 15, wherein the switching over of said bias voltage is carried out during the removal of said developer.

20. A developing apparatus according to claim 15, wherein the period of time during which said bias voltage is switched over to and maintained at said second voltage is shorter than a period of time beyond which the toner density begins to change.

* * * * *